United States Patent [19]

Wolfson

[11] 4,411,222

[45] Oct. 25, 1983

[54] SAFETY APPARATUS FOR PASSENGERS ON VEHICLES

[76] Inventor: Morton M. Wolfson, 70-34 Olcott St., Forest Hills, N.Y. 11375

[21] Appl. No.: 350,293

[22] Filed: Feb. 19, 1982

[51] Int. Cl.[3] ..... A01K 29/00; A41F 19/00

[52] U.S. Cl. ..... 119/96; 2/305

[58] Field of Search ..... 119/96; 2/93, 94, 96, 2/300, 305; 16/DIG. 12

[56] References Cited

U.S. PATENT DOCUMENTS

| | | | |
|---|---|---|---|
| 1,310,958 | 7/1919 | O'Connor | 119/96 |
| 1,930,378 | 10/1933 | Beagan | 119/96 |
| 2,563,766 | 8/1951 | Weinstein et al. | 119/96 |
| 3,533,107 | 10/1970 | Raneri | 2/93 |
| 3,562,812 | 2/1971 | Greggains | 2/94 |
| 4,028,742 | 6/1977 | Marquis | 2/305 |

*Primary Examiner*—Hugh R. Chamblee

*Attorney, Agent, or Firm*—Steinberg & Raskin

[57] ABSTRACT

Safety apparatus for passengers on vehicles, such as motorcycles, includes a pair of grip devices adapted to be attached to a belt or the like worn by the driver of the vehicle. Each grip device includes a handle member adapted to be gripped by the passenger so that his balance can be maintained even when the vehicle negotiates a sharp curve thereby eliminating the necessity of the passenger to hold the driver around his waist or hold onto his seat in order to maintain his balance.

4 Claims, 3 Drawing Figures

SAFETY APPARATUS FOR PASSENGERS ON VEHICLES

BACKGROUND OF THE INVENTION

This invention relates generally to safety apparatus for passengers on vehicles, and more particularly, to safety apparatus for use by passengers on vehicles such as motorcycles, snowmobiles and the like.

Passengers on vehicles, such as motorcycles, snowmobiles and the like, generally sit directly behind the driver, usually on the same seat. It is a well known fact that a passenger on a vehicle of this type usually must hold onto the driver, usually around his waist region, in order to maintain his balance, especially when the vehicle negotiates a sharp turn or travels over bumpy terrain or the like.

More particularly, since the driver naturally holds onto the handlebars or other steering mechanism as be drives the vehicle, there is little danger of his losing his balance. On the other hand, there is generally no provision made for any apparatus which is suitable for the passenger to hold onto to assist in maintaining his balance. As a result, the passenger usually must grasp either the seat on which he is sitting or the driver himself in order to maintain his balance as the vehicle changes direction.

Experience has proven, however, that holding onto the seat does not provide sufficient leverage to allow the passenger to maintain his balance, especially when the vehicle negotiates a sharp turn or the like. Moreover, holding onto the driver is both uncomfortable for the driver and can be dangerous to both the passenger and the driver for obvious reasons.

SUMMARY OF THE INVENTION

Accordingly, it is an object of the present invention to provide new and improved safety apparatus for passengers on vehicles, such as motorcycles, snowmobiles and the like.

Another object of the present invention is to provide new and improved safety apparatus which allows a passenger on a vehicle, such as a motorcycle, snowmobile or the like, to maintain his balance when the vehicle changes direction, such as when it negotiates a sharp turn or the like.

Still another object of the present invention is to provide new and improved safety apparatus of the type described above which is adjustably positionable in order to accommodate the particular amount of space, if any, left between the passenger and the driver of the vehicle.

Yet another object of the present invention is to provide new and improved safety apparatus of the type which can be gripped by a passenger of a vehicle, such as a motorcycle, snowmobile or the like, in a reliable and secure manner.

Briefly, in accordance with the present invention, these and other objects are obtained by providing safety apparatus including a pair of grip devices adapted to be attached to a belt of the like worn by the driver of the vehicle. Each grip device includes a handle member adapted to be gripped by a respective hand of the passenger.

The grip devices are provided with a feature whereby the same may be attached to the belt or the like at a selectively adjustable location in order to render the grip devices accessable to the passenger while accommodating the particular amount of space, if any, between the passenger and the driver of the vehicle.

The invention also relates to the particular structure of the grip device itself.

DESCRIPTION OF THE DRAWINGS

A more complete appreciation of the present invention and many of the intended advantages thereof will be readily appreciated when the same becomes better understood with reference to the following detailed description when considered in connection with the accompanying drawings in which.

DESCRIPTION OF THE PREFERRED EMBODIMENTS

Figure 1:
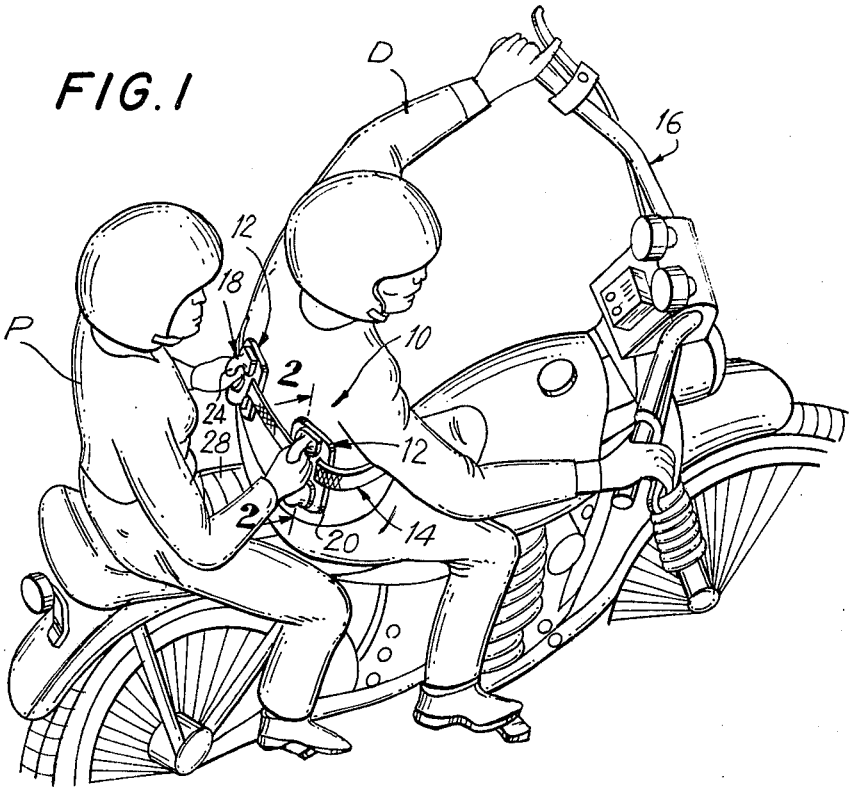
FIG. 1 is a perspective view illustrating the driver and a passenger of a vehicle, namely a motorcycle, and the safety apparatus in accordance with the present invention in use.
Figure 2:
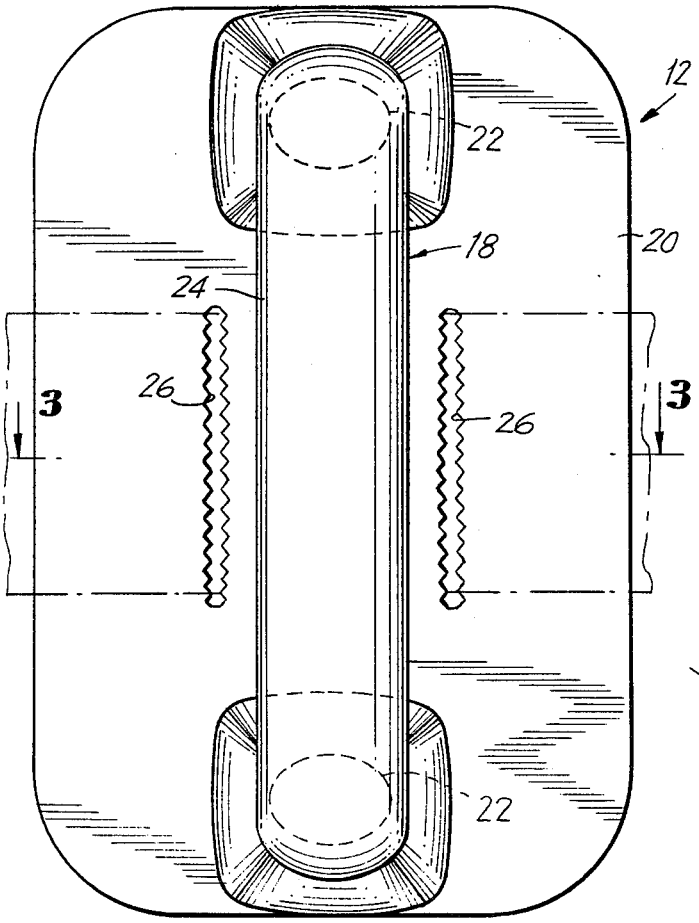
FIG. 2 is a front elevational view of the grip device in accordance with the present invention, and illustrating the same in conjunction with a belt or the like (shown in phantom)

Referring now to the drawings wherein like reference characters designate identical or corresponding parts throughout the several views, the safety apparatus of the present invention, generally designated 10, is shown in use in FIG. 1. In the illustrated embodiment, the apparatus generally comprises a pair of grip devices 12 attached to a belt 14 at a location thereof such that the grip devices are accessible to be gripped by a passenger P riding behind a driver D on motorcycle 16. It will be readily understood that the passenger will grasp the handle portions, described below, of the respective grip devices 12 during movement of the motorcycle. The safety apparatus of the present invention, described in greater detail below, provides a secure, reliable and convenient support which the passenger may grasp in order to maintain his balance while the vehicle is in motion and which thereby eliminates the prior necessity of the passenger to hold onto the body of the driver.

Each grip device 12 is preferably molded in a single unit from a suitable plastic material and is constituted by a substantially U-shaped handle member 18 affixed to a substantially rectangular plate member 20. Thus, the handle member 18 includes a pair of end legs 22 having respective end regions which are affixed to the plate member 20 and an intermediate leg 24 extending between and interconnecting the other end regions of end legs 22.

In order to attach the grip member 12 to the belt 14, a pair of spaced, parallel slots 26 are formed through the plate member 20, each slot 26 having a width which is sufficient to receive the thickness of the belt 14. The slots 26 are preferably formed having edges which are serrated to define teeth for reasons which will become clear below.

Figure 3:
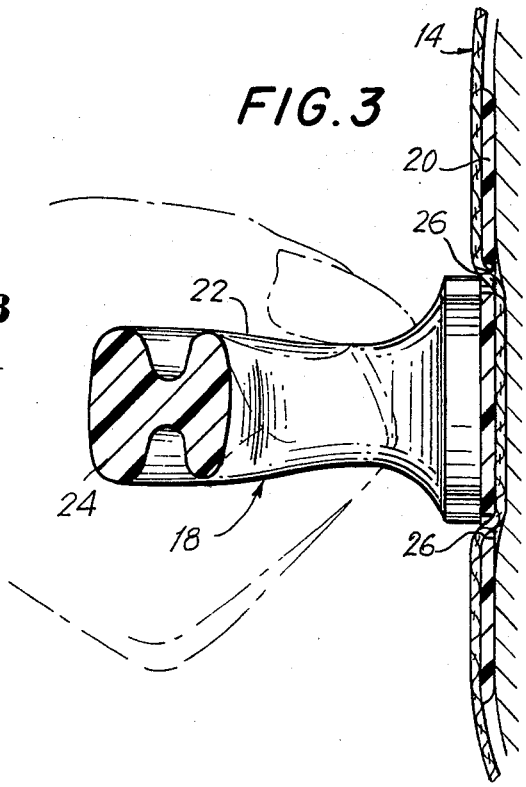
FIG. 3 is a section view taken along line 3—3 of FIG. 2.

Referring to FIG. 3, in the assembly of the safety apparatus 10, the end of the belt 14 is passed through a first one of the slots 26 from the side of the plate member from which the handle member extends and then through the second slot 26 from the opposite side. The belt 14 can then be pulled through the slots 26 to position the respective grip devices 12 at an appropriate location such as that illustrated in FIG. 1.

The above-described construction is advantageous in that it permits the grip devices to be located at a suitable location on belt 14 to accommodate both the comfort of the passenger as well as to take into account the amount of space between the passenger and the driver. Thus, where the seat 28 of the motorcycle 16 is sufficiently long to allow for some room to be left between the seated passenger P and the driver D as is the case illustrated in FIG. 1, the grip devices can be located on belt 14 such that they extend generally rearwardly from the back of the driver. On the other hand when the seat is relatively short such that the passenger is quite close to the driver, the grip devices can be moved laterally to a location on the belt 14 wherein they extend from the hip region of the driver. This adaptability of location of the grip devices is an advantageous feature of the present invention.

The belt 14 preferably is formed of a reinforced weatherproof material which is somewhat pliable and which is provided with an adjustable buckle to allow the same to be tightened over a wide range of waist sizes. The serrations or teeth forming the periphery of the slots 26 tend to bite into the belt material when the latter is tightened around the driver's waist, thereby preventing any undesired shifting of the grip devices during use.

As seen in the figures, the U-shaped handle member 18 and plate member 20 together define a closed loop structure for the grip device. Such closed loop structure is advantageous in that the possibility of the passenger's hand inadvertently slipping from the grip device is reduced. Moreover, the end legs 22 of handle member 18 preferably extend at right angles from the intermediate leg 24 so that the passenger's hand will be substantially confined to gripping that intermediate leg 24.

Moreover, according to another feature of the illustrated preferred embodiment, the intermediate leg 24 extends in a direction which is substantially parallel to the direction in which the parallel slots 26 extend. In this manner, the intermediate leg 24 of each grip device will advantageously extend in a substantially vertical direction, i.e., perpendicular to the run of the belt 14, which of course passes through the slots 26 in a direction perpendicular to their longitudinal dimensions. This configuration of the grip device is preferred, again from the viewpoint of comfort.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Safety belt apparatus for passengers on vehicles, such as motorcycles and the like, said apparatus comprising:

a belt adapted to encircle the waist region of a vehicle operator;

a pair of grip devices attached to said belt, each grip device including a substantially U-shaped handle portion having a pair of free ends and a substantially planar plate member to which said free ends of said U-shaped handle portion are fixed so that said handle portion and plate together define a closed loop, said plate member being situated in a plane which is substantially normal to a plane in which said U-shaped handle portion is situated, and wherein a pair of spaced, parallel slots are formed through said plate member, said slots being substantially parallel to the plane in which said handle portion is situated; and wherein said belt extends through said pair of slots of each of said grip devices so that said grip devices are attached to said belt and are adjustably positionable thereon.

2. The combination of claim 1 wherein said handle portion includes a pair of end legs and an intermediate leg situated between and interconnecting said end legs, said intermediate leg extending at substantially right angles to said end legs.

3. The combination of claim 1 wherein the region of said plate member defining the edges of said slots are serrated to define teeth extending into said slots.

4. The combination of claim 1 wherein each of said grip devices is constituted by an integrally molded unitary member.

* * * * *